US010373771B2

(12) United States Patent
Hammer

(10) Patent No.: US 10,373,771 B2
(45) Date of Patent: Aug. 6, 2019

(54) TAP-CHANGER SWITCHING SYSTEM AND METHOD OF OPERATING SAME

(71) Applicant: Maschinenfabrik Reinhausen GmbH, Regensburg (DE)

(72) Inventor: Christian Hammer, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 443 days.

(21) Appl. No.: 15/303,812

(22) PCT Filed: Apr. 27, 2015

(86) PCT No.: PCT/EP2015/059060
§ 371 (c)(1),
(2) Date: Oct. 13, 2016

(87) PCT Pub. No.: WO2015/176918
PCT Pub. Date: Nov. 26, 2015

(65) Prior Publication Data

US 2017/0062146 A1 Mar. 2, 2017

(30) Foreign Application Priority Data

May 19, 2014 (DE) ..... 10 2014 106 997

(51) Int. Cl.
*H01H 9/00* (2006.01)
*H01F 29/04* (2006.01)
(Continued)

(52) U.S. Cl.
CPC ..... *H01H 9/0016* (2013.01); *H01F 27/29* (2013.01); *H01F 29/04* (2013.01); *H01H 3/38* (2013.01); *H01H 9/0027* (2013.01)

(58) Field of Classification Search
CPC ..... H01H 9/0016
See application file for complete search history.

(56) References Cited

U.S. PATENT DOCUMENTS 3,555,403 A * 1/1971 Matzl et al. ..... H01F 29/04 323/343
3,643,154 A * 2/1972 Van Riemsdijk .... H01H 9/0005 323/340

(Continued)

FOREIGN PATENT DOCUMENTS

CA 2798959 A1 * 11/2011 ..... H01F 29/04
DE 960303 B 3/1957

(Continued)

*Primary Examiner* — Elvin G Enad
*Assistant Examiner* — Malcolm Barnes
(74) *Attorney, Agent, or Firm* — Andrew Wilford

(57) ABSTRACT

The invention relates to a switching system for a tapped transformer with on-load tap changer wherein the tapped transformer comprises a main winding with a first main terminal;
a coarse winding with a first coarse terminal and with a second coarse terminal;
a control winding with a first control terminal; and
an on-load tap changer that has a switch terminal and that interacts with the control winding;

the switching system comprising a lead;
a first switch subassembly comprising
a first main fixed contact that can be connected to the first main terminal;
a first coarse fixed contact that can be connected to the first coarse terminal;
a first control fixed contact that can be connected to the first control terminal;
a first switch fixed contact that can be connected to the first switch terminal; and
a first movable bridge contact that is formed such that it electrically bridges or connects at least two fixed contacts of its switch subassembly in each stationary (Continued)

operating position of the switching system and/or during each switch over process of the switching system;

a second switch subassembly comprising a second coarse fixed contact that can be connected to the second coarse terminal;

a second control fixed contact that can be connected to the first control terminal and/or that is connected to the first control fixed contact;

a second switch fixed contact that can be connected to the switch terminal and/or that is connected to the first switch fixed contact; and a second movable bridge contact that is formed such that it electrically bridges at least two fixed contacts of its switch subassembly in each stationary operating position of the switching system and/or during each switch-over process of the switching system; and a third switch subassembly comprising a first lead fixed contact that is connected to the lead;

a third coarse fixed contact that can be connected to the first coarse terminal and/or that is connected to the first coarse fixed contact;

a third control fixed contact that can be connected to the first control terminal and/or that is connected to the first control fixed contact;

a third switch fixed contact that can be connected to the switch terminal and/or that is connected to the first switch fixed contact; and a third movable bridge contact that is formed such that it electrically bridges at least two fixed contacts of its switch subassembly in each stationary operating position of the switching system and/or during each switch over process of the switching system.

24 Claims, 2 Drawing Sheets

(51) Int. Cl.
*H01F 27/29* (2006.01)
*H01H 3/38* (2006.01)

(56) References Cited

U.S. PATENT DOCUMENTS

| | | | | |
|---|---|---|---|---|
| 2010/0059356 | A1* | 3/2010 | Hammer | H01H 1/36 200/6 R |
| 2014/0167529 | A1* | 6/2014 | Teising | H01H 9/0027 307/134 |
| 2015/0162144 | A1* | 6/2015 | Panosyan | H01H 9/0011 200/11 TC |

FOREIGN PATENT DOCUMENTS

| | | | | |
|---|---|---|---|---|
| DE | 960303 | C * | 3/1957 | H01H 9/0005 |
| DE | 1942567 | A1 * | 3/1971 | H01F 29/04 |
| DE | 2358885 | A | 6/1975 | |
| DE | 2936493 | A | 3/1981 | |
| DE | 2936493 | A1 * | 3/1981 | H01F 29/02 |
| DE | 2936534 | A | 3/1981 | |
| DE | 2936534 | A1 * | 3/1981 | H01F 29/02 |
| GB | 1241822 | B | 8/1971 | |

* cited by examiner

TAP-CHANGER SWITCHING SYSTEM AND METHOD OF OPERATING SAME

CROSS REFERENCE TO RELATED APPLICATIONS

This application is the US-national stage of PCT application PCT/EP2015/059060 filed 27 Apr. 2015 and claiming the priority of German patent application 102014106997.8 itself filed 19 May 2014.

The present invention relates to a switching system for a tapped transformer and to a method of operating such a switching system.

For the purpose of changing the transmission ratio of tapped transformers under load, so-called on-load tap changers are provided, the structure and function of which are in principle known and that are designed to switch the winding taps of a control winding of the tapped transformer.

Such an on-load tap changer that is connected to the control winding commonly has a load diverter switch and a selector. The selector is provided for the purpose of powerless selection or, as the case may be, contacting, of the winding tap to be connected. Besides the selector in certain technical applications that require a greater control range, it has been moreover long known to additionally provide a preselector that, according to application, can be formed either as changeover selector for additive and subtractive switching of the control winding or as coarse selector for the linkage of the control winding to the beginning or to the end of the main winding of the tapped transformer.

The actual load transfer, however, is always carried out by the load diverter switch, namely from the previous winding tap to the new, preselected winding tap. For this purpose, the load diverter switch usually has mechanical switch contacts and resistance contacts, with the switch contacts serving for direct connection of the respective winding taps to the load dissipation, and the resistance contacts serving for temporary bridging by one or more transition resistances. The developments of the past years, however, lead away from load diverter switches with mechanical switch contacts and toward using vacuum switching tubes or semiconductor switching components, in particular circuit breaker components, as switching components for high voltages and currents, for example thyristors, GTOs, IGBTs, and other components.

Integrated on-load tap changers that are also called load selectors, are another genus of on-load tap changers. In these, the load diverter switch and the fine selector are constructed as one unit. Upon actuation, the winding tap to be switched is preselected and subsequently switched in a single step. This form of realization of an on-load tap changer can also have a preselector that is arranged either outside or inside the housing of the on-load tap changer, specifically in an insulation medium, preferably in insulation oil.

It is already known from DE 960 303 to provide an on-load tap changer with selector arms, of which in each case one selector arm is current-carrying and is in contact with a tap of a control winding of the tapped transformer during stationary operation. Moreover provided is a further auxiliary tap that is connected to the end of the main winding of the tapped transformer, which main winding is connected upstream of the control winding. The current-carrying selector arm is in contact with this auxiliary tap when the so-called changeover switch for the control winding, which in this technical context is also referred to as fine winding, switches over. This changeover switch in turn is also connected to the upstream main winding on the one side and to the winding ends of the control winding on the other side such that the voltage of the control winding is added to or subtracted from the voltage of the upstream main winding according to the position of the changeover switch contact. This type of electrical circuitry has become known as so-called changeover circuit.

From DE 23 58 885 it is furthermore already known to connect a so-called coarse winding upstream of a fine winding with the beginning of the main winding being connected to the tapped transformer. Provided for the coarse winding is a changeover switch, the center contact of which is connected to the beginning of the fine winding and the external contacts of that are connected to the beginning and the end of the coarse winding. According to the position of the changeover switch, the voltage of the coarse winding is thereby added or it is not added to the voltage of the main winding and to the voltage of the fine winding. This type of electrical circuitry has become known as so-called coarse step.

Finally, as already known from DE 29 36 534 A1, there is a switch subassembly for a transformer stage selector, in which a main winding, a fine winding equipped with taps for selector arms for voltage adjustment, and at least one coarse winding arranged at the same leg of the transformer are provided per phase; in which a changeover switch is connected with its external contacts to the beginning and the end of each coarse winding, and the center contact of each changeover switch is connected to the beginning of the coarse winding having the next higher potential; and in which an auxiliary tap is provided that is connectable to a coarse winding and to the current-carrying selector arm. In this known switching system, it is provided that the center contact of the changeover switch connected to the coarse winding with the highest potential is connected to the center contact of a reversing changeover switch; that the external contacts of the reversing changeover switch are connected to the beginning and the end of the fine winding; that the auxiliary tap is connected to the center contact of an auxiliary changeover switch, the external contacts of that are connected to the end of the upstream coarse winding and to the center contact of an auxiliary changeover switch that is connected to the next upstream coarse winding in the same manner, whereas the auxiliary changeover switch connected to the coarse winding immediately downstream of the main winding is connected with both external contacts to the coarse winding; and that the contacts of each changeover switch, of the reversing changeover switch, and of each auxiliary changeover switch are arranged at different levels of the stage selector.

What is disadvantageous in the circuits as known from the prior art is that a resistor known as tie-in resistors has to be provided in order to ensure that the potential of the control winding or of the fine winding, as the case may be, takes a defined value when switching over the changeover switch. This is the case because the control winding is electrically floating, that is, not galvanically linked, at the point of time of switching over the switch over contact. Via capacitive couplings, the control winding therefore takes a potential that is unpredictable, and this can in turn lead to considerable voltages at the pre-selector, which voltages in turn can be technically controlled only with difficulty.

The object of the present invention is therefore to specify a switching system for a tapped transformer as well as a method of operating such a switching system in which the previously mentioned disadvantages are eliminated.

This object is achieved according to the invention by the subject matter of the independent claims. Advantageous developments and embodiments of the invention are described in the corresponding dependent claims.

According to a first aspect of the invention, there is proposed a switching system for a tapped transformer comprising

- a main winding with a first main terminal;
- a coarse winding with a first coarse terminal and with a second coarse terminal;
- a control winding with a first control terminal; and
- an on-load tap changer that has a switch terminal and that interacts with the control winding;

the switching system comprising

- a lead;
- a first switch subassembly comprising
  - a first main fixed contact that can be connected to the first main terminal;
  - a first coarse fixed contact that can be connected to the first coarse terminal;
  - a first control fixed contact that can be connected to the first control terminal;
  - a first switch fixed contact that can be connected to the first switch terminal; and
  - a first movable bridge contact that is formed such that it electrically bridges or connects at least two fixed contacts of its switch subassembly in each stationary operating position of the switching system and/or during each switch over process of the switching system;
- a second switch subassembly comprising
  - a second coarse fixed contact that can be connected to the second coarse terminal;
  - a second control fixed contact that can be connected to the first control terminal and/or that is connected to the first control fixed contact;
  - a second switch fixed contact that can be connected to the switch terminal and/or that is connected to the first switch fixed contact; and
  - a second movable bridge contact that is formed such that it electrically bridges at least two fixed contacts of its switch subassembly in each stationary operating position of the switching system and/or during each switch-over process of the switching system; and
- a third switch subassembly comprising
  - a first lead fixed contact that is connected to the lead;
  - a third coarse fixed contact that can be connected to the first coarse terminal and/or that is connected to the first coarse fixed contact;
  - a third control fixed contact that can be connected to the first control terminal and/or that is connected to the first control fixed contact;
  - a third switch fixed contact that can be connected to the switch terminal and/or that is connected to the first switch fixed contact; and a third movable bridge contact that is formed such that it electrically bridges at least two fixed contacts of its switch subassembly in each stationary operating position of the switching system and/or during each switch over process of the switching system.

In this way, a switching system is provided in which all sections of each main winding, of each coarse winding as well as of each control winding of the tapped transformer are galvanically linked, that is, not electrically floating, at each point of time during each switch over. An additional tie-in resistor is therefore not needed. With this switching assembly it is moreover possible to switch a control range that has the fourfold voltage range of the control winding by additively or, as the case may be, subtractively connecting the various parts of the main winding, the coarse winding, as well as the control winding, that is, by correspondingly alternatingly reversing the polarity.

It can be provided that there is a drive shaft, at which the bridge contacts are nonrotatably arranged.

It can be provided that the drive shaft is coupled to an actuator.

It can be provided that the actuator comprises a motor drive and/or a direct drive and/or a manual drive and/or a spring energy storage device.

It can be provided that the first switch subassembly comprises

- a second and a third main fixed contact that can each be connected to the first main terminal and/or that are connected to the first main fixed contact; and
- a fourth coarse fixed contact that can be connected to the first coarse terminal and/or that is connected to the first coarse fixed contact;
- the first main fixed contact is arranged between the first switch fixed contact and the first control fixed contact;
- the third main fixed contact is arranged between the first control fixed contact and the fourth coarse fixed contact; and that
- the second main fixed contact is arranged between the fourth coarse fixed contact and the first coarse fixed contact.

It can be provided that the second switch subassembly

- a fifth and a sixth coarse fixed contact that can each be connected to the second coarse terminal and/or that are connected to the second coarse fixed contact;
- a fourth control fixed contact that can be connected to the first control terminal and/or that is connected to the first control fixed contact; and
- a fourth switch fixed contact that can be connected to the switch terminal and/or that is connected to the first switch fixed contact;
- the second coarse fixed contact is arranged between the second control fixed contact and the fourth switch fixed contact;
- the sixth coarse fixed contact is arranged between the fourth switch fixed contact and the second switch fixed contact; and that
- the fifth coarse fixed contact is arranged between the second control fixed contact and the fourth switch fixed contact;

It can be provided that the third switch subassembly comprises

- a second and a third lead fixed contact that are each connected to the lead and/or to the first lead fixed contact; and
- a seventh coarse fixed contact that can be connected to the first coarse terminal and/or that is connected to the first coarse fixed contact;
- the first lead fixed contact is arranged between the third coarse fixed contact and the seventh coarse fixed contact;
- the third lead fixed contact is arranged between the seventh coarse fixed contact and the third control fixed contact; and that
- the second lead fixed contact is arranged between the third control fixed contact and the third switch fixed contact.

It can be provided that the respective fixed contacts in each switch subassembly are arranged rotationally symmetrically and/or on a circular orbit around the drive shaft.

It can be provided that the individual switch subassemblies are formed to be electrically insulated from each other.

It can be provided that the switch subassemblies are arranged in different horizontal planes.

According to a second aspect of the invention, there is proposed a switching system for a tapped transformer comprising a main winding with a first main terminal;

a coarse winding with a first coarse terminal and with a second coarse terminal;

a control winding with a first control terminal; and an on-load tap changer that has a switch terminal and that interacts with the control winding;

the switching system comprising a lead, wherein the switching system, which is in particular designed according to the first aspect, is, in particular if it is connected to the main winding, the coarse winding, the control winding, and the on-load tap changer, designed such that it can assume a first stationary operating position, in which it switches the coarse winding anti-serially and the control winding, or at least a part of it, antiserially to the main winding;

it can assume a second stationary operating position, in which it switches the coarse winding anti-serially and the control winding, or at least a part of it, serially to the main winding;

it can assume a third stationary operating position, in which it switches the coarse winding serially and the control winding antiserially to the main winding; and that it can assume a fourth stationary operating position, in which it switches the coarse winding serially and the control winding serially to the main winding.

It can be provided that the switching system comprises several fixed contacts, at least one of which can in each case be connected to the first main terminal, the first coarse terminal, the first control terminal, the switch terminal, the second coarse terminal, the first control terminal, and the switch terminal and at least one other one of that is connected to the lead; and three movable bridge contacts that each electrically bridge at least two fixed contacts.

It can be provided that the switching system can switch over from the first operating position to the second operating position, from the second operating position to the first and to the third operating position, from the third operating position to the second and to the fourth operating position, and from the fourth operating position to the third operating position; and/or that it cannot switch over from the first operating position to the fourth operating position, nor from the fourth operating position to the first operating position.

It can be provided that the switching system switches a current path through the control winding; and/or that it switches the first control terminal and the switch terminal or the control winding to the main terminal and the lead or to the main winding and/or the coarse winding in each operating position and/or during each switch over process.

Particularly preferably, it switches a current path, in particular, from the main terminal through the control winding, or at least through a part of it, in particular to the lead, and/or it switches the first control terminal and the switch terminal or the control winding, or at least a part of it, to the main terminal and to the lead or to the main winding and/or to the coarse winding in each operating position and/or during each switch over process.

It can be provided that the main winding, the coarse winding, and the control winding are galvanically separated from one another.

According to a third aspect of the invention, there is proposed a tapped transformer comprising a main winding with a first main terminal;

a coarse winding with a first coarse terminal and with a second coarse terminal;

a control winding with a first control terminal and an on-load tap changer that has a switch terminal and that interacts with the control winding; and a switching system that is designed according to the first or second aspect.

It can be provided that the first main fixed contact is connected to the first main terminal;

the first coarse fixed contact is connected to the first coarse terminal;

the first control fixed contact is connected to the first control terminal;

the first switch fixed contact is connected to the first switch terminal;

the second coarse fixed contact is connected to the second coarse terminal;

the second control fixed contact is connected to the first control terminal and/or to the first control fixed contact;

the second switch fixed contact is connected to the first switch terminal and/or to the first switch fixed contact;

the first lead fixed contact is connected to the lead;

the third coarse fixed contact is connected to the first coarse terminal and/or to the first coarse fixed contact;

the third control fixed contact is connected to the first control terminal and/or to the first control fixed contact; and the third switch fixed contact is connected to the first switch terminal and/or to the first switch fixed contact;

It can be provided that the main winding, the coarse winding, and the control winding are galvanically separated from one another.

According to a fourth aspect of the invention, there is proposed a method of operating a switching system that is in particular designed according to the first or second aspect, wherein the switching system is operated in four stationary operating positions such that the coarse winding and/or the control winding of the main winding is in each case additively and/or subtractively connected in dependence on the corresponding operating position.

According to a fifth aspect of the invention, there is proposed a method of operating an electrical system comprising a main winding with a first main terminal;

a coarse winding with a first coarse terminal and with a second coarse terminal;

a control winding with a first control terminal;

an on-load tap changer that has a switch terminal and that interacts with the control winding;

a lead; and, in particular, a switching system that is designed according to the first or second aspect claims;

wherein the method is in particular designed according to the fourth aspect;

the coarse winding is switched antiserially and the control winding, or at least a part of it, is switched antiserially to the main winding in a first stationary operating position;

the coarse winding is switched antiserially and the control winding, or at least a part of it, is switched serially to the main winding in a second stationary operating position;

the coarse winding is switched serially and the control winding is switched antiserially to the main winding in a third stationary operating position; and the coarse winding is switched serially and the control winding is switched serially to the main winding in a fourth stationary operating position.

It can be provided that, in the first stationary operating position, the first main terminal is electrically connected to the first main fixed contact; the first bridge contact electrically bridges the first main fixed contact and the first switch fixed contact; and the first switch fixed contact is electrically connected to the switch terminal;

the second coarse fixed contact is electrically connected to the second coarse terminal; the second bridge contact electrically bridges the second coarse fixed contact and the second control fixed contact; and the second control fixed contact is electrically connected to the first control terminal; and the third coarse fixed contact is electrically connected to the first coarse terminal; the third bridge contact electrically bridges the first lead fixed contact and the third coarse fixed contact; and the first lead fixed contact is electrically connected to the lead.

It can be provided that, in the second stationary operating position, the first main terminal is electrically connected to the first main fixed contact and to the third main fixed contact; the first bridge contact electrically bridges the first main fixed contact, the third main fixed contact, and the first control fixed contact; and the first control fixed contact is electrically connected to the first control terminal;

the second coarse fixed contact and the sixth coarse fixed contact are electrically connected to the second coarse terminal; the second bridge contact electrically bridges the second coarse fixed contact, the sixth coarse fixed contact, and the fourth switch fixed contact; and the fourth switch fixed contact is electrically connected to the switch terminal; and the first lead fixed contact and the third lead fixed contact are connected to the lead; the third bridge contact electrically bridges the first lead fixed contact, the third lead fixed contact and the seventh coarse fixed contact; and the seventh coarse fixed contact is electrically connected to the first coarse terminal.

It can be provided that, in the third stationary operating position, the first main terminal is electrically connected to the third main fixed contact and to the second main fixed contact; the first bridge contact electrically bridges the third main fixed contact, the second main fixed contact, and the fourth coarse fixed contact; and the fourth coarse fixed contact is electrically connected to the first coarse terminal;

the fifth coarse fixed contact and the sixth coarse fixed contact are electrically connected to the second coarse terminal; the second bridge contact electrically bridges the fifth coarse fixed contact, the sixth coarse fixed contact, and the second switch fixed contact; and the second switch fixed contact is electrically connected to the switch terminal; and the second lead fixed contact and the third lead fixed contact is connected to the lead; the third bridge contact electrically bridges the second lead fixed contact, the third lead fixed contact, and the third control fixed contact; and the third control fixed contact is electrically connected to the first control terminal.

It can be provided that, in the fourth stationary operating position, the first main terminal is electrically connected to the second main fixed contact; the first bridge contact electrically bridges the second main fixed contact and the first coarse fixed contact; and the first coarse fixed contact is electrically connected to the first coarse terminal;

the fifth coarse fixed contact is electrically connected to the second coarse terminal; the second bridge contact electrically bridges the fifth coarse fixed contact and the fourth control fixed contact; and the fourth control fixed contact is electrically connected to the first control terminal; and the third switch fixed contact is electrically connected to the switch terminal; the third bridge contact electrically bridges the third switch fixed contact and the second lead fixed contact; and the second lead fixed contact is electrically connected to the lead.

The electrical system can comprise a tapped transformer as proposed according to the third aspect, for example, or it can be designed like a tapped transformer as proposed according to the third aspect.

The explanations and exemplifications regarding one of the aspects of the invention, in particular regarding individual features of this aspect, also apply correspondingly for the other aspects of the invention.

In the following, embodiments of the invention are exemplarily explained in detail by means of the attached drawings. The individual features thereof are, however, not limited to the individual embodiments but can be connected and/or combined with individual features described further above and/or with individual features of other embodiments. Each example in the illustrations is provided by way of explanation, not limitation of the invention. The reference characters included in the claims are by no means intended to limit the scope of protection of the invention, but rather merely refer to the embodiments shown in the figures, in which FIG. 1 shows a switching system according to the invention in a first stationary operating position;

Figure 1:
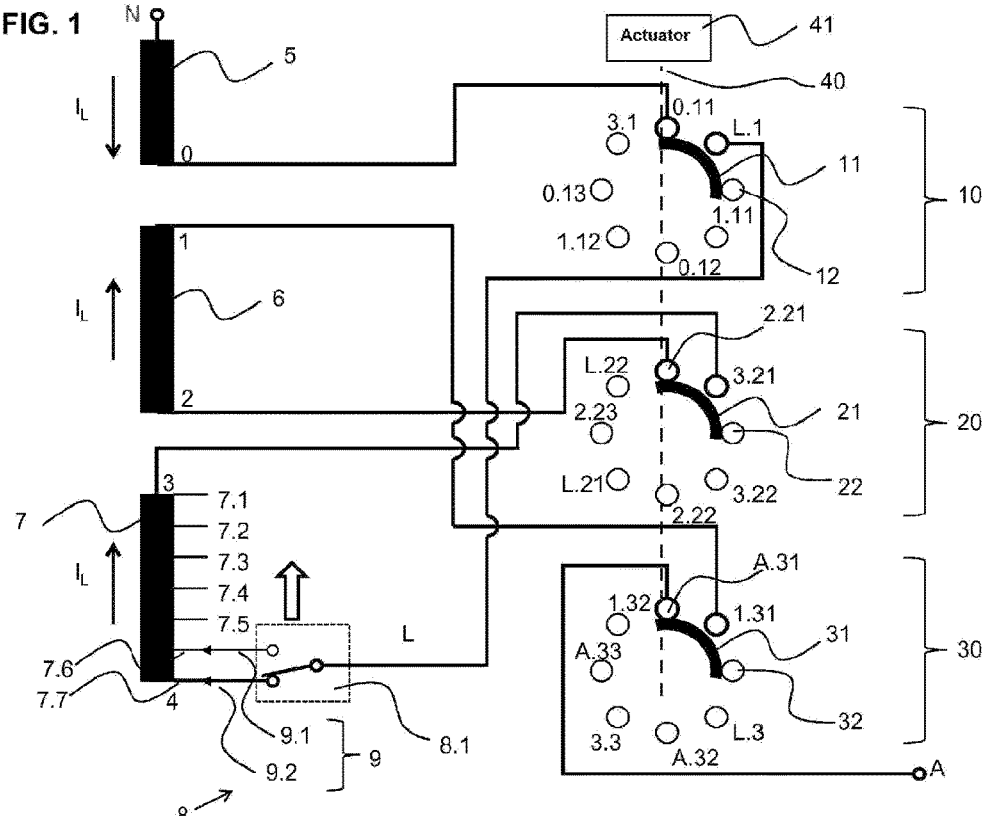

Shown in FIG. 1 is a switching system according to the invention with a stylized, only partly illustrated tapped transformer and with an on-load tap changer 8 in a first stationary operating position. In this context, FIG. 1 does not show the entire tapped transformer, but rather only those parts of the winding of the tapped transformer that correspond to the switching system according to the invention, where the winding here can be the primary side or the secondary side. The tapped transformer has a main winding 5 with a first main terminal 0 and with a second main terminal N, which second main terminal N can be connected to a power line that is associated with a phase of an alternating current network, or to a star point or to a vertex of a delta connection. Also provided is a lead A that can be connected to chassis ground or to earth or to a star point or to a vertex of a delta connection. The tapped transformer furthermore provides a coarse winding 6 with a first coarse terminal 1 and with a second coarse terminal 2; and a control winding 7 with a first control terminal 3, with a second control terminal 4, and with a plurality of winding taps 7.1 . . . 7.7; as well as an on-load tap changer 8 arranged between the control winding 7 and a switch terminal L. The on-load tap changer 8 can be an on-load tap changer as known for many decades from the prior art. In this context, the winding tap 7.1 has the same potential as the first control terminal 3, while the winding tap 7.7 has the same potential as the second control terminal 4. The on-load tap changer 8 in turn comprises an also already known load diverter switch 8.1 as well as a selector 9 that performs a powerless preselection of the winding taps 7.1 . . . 7.7 of the control winding 7 with its selector arms 9.1 and 9.2 prior to the load diverter switch 8.1 performing the actual uninterrupted switch over under load. The on-load tap changer 8 can alternatively also be an integrated on-load tap changer 8 as is known from the prior art. No matter whether the on-load tap changer 8 with its selector 9 is formed as a separate unit as load diverter switch 8.1 or whether it is integrated, it is formed such that it can move to the entire control range of the control winding 7, that is, to all winding taps 7.1 . . . 7.7 present, and is electrically contactable to these.

In this context, the switching system provides a first switch subassembly 10 and a second switch subassembly 20 as well as a third switch subassembly 30. Each switch subassembly 10, 20, and 30 for its part in turn comprises several fixed contacts 0.11, 0.12, 1.11 . . . 1.13, 1.31, 1.32, 2.21 . . . 2.23, 3.1, 3.21, 3.22, 3.3, L.1, L.21, L.22, L.3, A.31 . . . A.33, where each of the switch subassemblies 10, 20, and 30 in each case has a movable bridge contact 11, 21, and 31 that is formed to be electrically bridging, and that is in each case dimensioned such that said bridge contact 11, 21, and 31 bridges at least two fixed contacts of each switch subassembly 10, 20, and 30 simultaneously during each switch over process of the switching system. During each stationary operating position, each movable bridge contact 11, 21, 31 is essentially also electrically in an operative connection with at least two fixed contacts 0.11, 0.12, 1.11 . . . 1.13, 1.31, 1.32, 2.21 . . . 2.23, 3.1, 3.21, 3.22, 3.3, L.1, L.21, L.22, L.3, A.31 . . . A.33 of each switch subassembly 10, 20, and 30. For this purpose, the respective movable bridge contact 11, 21, and 31 of each switch subassembly 10, 20, and 30 is nonrotatably connected with a drive shaft 40 that is provided collectively for all switch subassemblies 10, 20, and 30.

The first switch subassembly 10 in this context comprises, in particular, the first, second, and third main fixed contact 0.11, 0.12, and 0.13, the first coarse fixed contact 1.11, the fourth coarse fixed contact 1.12, the first control fixed contact 3.1, and the first switch fixed contact L.1 that are electrically contactable with the associated terminals 0, 1, 3 and L such that, for example, the first, second, and third main fixed contact 0.11, 0.12, 0.13 correspond with first main terminal 0, the first and the fourth coarse fixed contact 1.11, 1.12 correspond with the first coarse terminal 1, the first control fixed contact 3.1 corresponds with the first control terminal 3, and the switch fixed contact L.1 corresponds with the switch terminal L according to the stationary operating position. The reference characters of the fixed contacts in the present patent application are here selected such that the digit in front of the point indicates the respectively corresponding terminal, with which the respective fixed contact electrically corresponds, the first digit after the point stands for the respective switch subassembly 10, 20, or 30, as the case may be, which the fixed contact is associated to, and the last digit of the corresponding switch subassembly numbers the fixed contacts consecutively in clockwise order. The nomenclature of the reference characters applies in consecutive order to all fixed contacts of the switch subassemblies 10, 20, and 30. If, for example, two fixed contacts of different switch subassemblies are electrically in contact with one and the same terminal during a switch over process, that is, in a middle position that is only temporarily taken, then the fixed contacts of the different switch subassemblies are also electrically connected among each other.

The second switch subassembly 20 in this context comprises, in particular, the second coarse fixed contact 2.21, the fifth coarse fixed contact 2.22, the sixth coarse fixed contact 2.23, the second control fixed contact 3.21, the fourth control fixed contact 3.22, the second switch fixed contact L.21, and the fourth switch fixed contact L.22 that are electrically contactable with the associated terminals 2, 3, and L, that is, for example, the second coarse fixed contact 2.21, the fifth coarse fixed contact 2.22, and the sixth coarse fixed contact 2.23 are contactable with the second coarse terminal 2, the second control fixed contact 3.21 and the fourth control fixed contact 3.22 are contactable with the first control terminal 3, and the second switch fixed contact L.21 and the fourth switch fixed contact L.22 are contactable with the switch terminal L according to the stationary operating position.

The third switch subassembly 30 in this context comprises, in particular, the first lead fixed contact A.31, the second lead fixed contact A.32, the third lead fixed contact A.33, the third coarse fixed contact 1.31, the seventh coarse fixed contact 1.32, the third control fixed contact 3.3, and the third switch fixed contact L.3 that are electrically contactable with the associated terminals 1, 3, L, and A, that is, for example, the third coarse fixed contact 1.31 and the seventh coarse fixed contact 1.32, are contactable with the first coarse terminal 1, the third control fixed contact 3.3 is contactable with the first control terminal 3, and the first lead fixed contact A.31, the second lead fixed contact A.32, and the third lead fixed contact A.33 are contactable with the lead A according to the stationary operating position.

Each switch subassembly 10, 20, and 30 moreover has a further vacant contact 12, 22, or 32, as the case may be, that corresponds with no further terminal or no further fixed contacts of the other switch subassemblies. From a circuit-technical point of view, it would also be conceivable to dispense with these vacant contacts 12, 22, or 32, as the case may be, of the switch subassemblies 10, 20, and 30.

Shown in FIG. 1 is the first of four possible stationary operating positions. The selector arms 9.1 and 9.2 or, as the case may be, the on-load tap changer 8, can run through the entire control range of the control winding 7 in both directions in each stationary operating position. In a first stationary operating position, the load current IL takes the path from the second main terminal N through the main winding 5, up to the first main terminal 0, to the first main fixed contact 0.11 of the first switch subassembly 10, from there via the first bridge contact 11 up to the switch fixed contact L.1, from there to the switch terminal L via the on-load tap changer 8 and via the selector 9 to the second control terminal 4; and subsequently the load current IL runs through the entire control winding 7 up to the first control terminal 3. From there, the load current IL flows on to the second coarse fixed contact 2.21 of the second switch subassembly 20, then via the second bridge contact 21 to the fourth switch fixed contact L.22, from there to the second coarse terminal 2, through the entire coarse winding 6 up to the first coarse terminal 1, and finally from there, via the third coarse fixed contact 1.31 of the third switch subassembly 30 and via the third bridge contact 31 to the first lead fixed contact A.31, to the lead A.

For this purpose, the first main terminal 0 is electrically connected to the first main fixed contact 0.11 in the first stationary operating position, the first bridge contact 11 electrically bridges the first main fixed contact 0.11 and the first switch fixed contact L.1, and the first switch fixed contact L.1 is electrically connected to the switch terminal L. Furthermore, the second coarse fixed contact 2.21 is electrically connected to the second coarse terminal 2; the second bridge contact 21 electrically bridges the second coarse fixed contact 2.21 and the second control fixed contact 3.21; and the second control fixed contact 3.21 is electrically connected to the first control terminal 3. Finally, the third coarse fixed contact 1.31 is electrically connected to the first coarse terminal 1; the third bridge contact 31 electrically bridges the first lead fixed contact A.31 and the third coarse fixed contact 1.31; and the first lead fixed contact A.31 is electrically connected to the lead A. In this first stationary operating position, a mechanical switch can moreover be provided between the first coarse terminal 1 and the first coarse fixed contact 1.11 as well as the fourth coarse fixed contact 1.12, which mechanical switch can be open in this stationary operating position.

Initiating a rotation of the drive shaft 40 can here be carried out by an actuator 41 provided collectively for all switch subassemblies 10, 20, and 30. The actuator 41 can then comprise a motor drive and/or a direct drive and/or a manual drive and/or a spring energy storage device, for example. If it is intended to carry out a switch over from a first into a second stationary operating position by the switching system according to the invention, it is necessary to move to the beginning of and to switch the control winding 7, that is the winding tap 7.1 provided at the first control terminal 3, by the selector arm 9.1 or 9.2 for this purpose.

Figure 2:
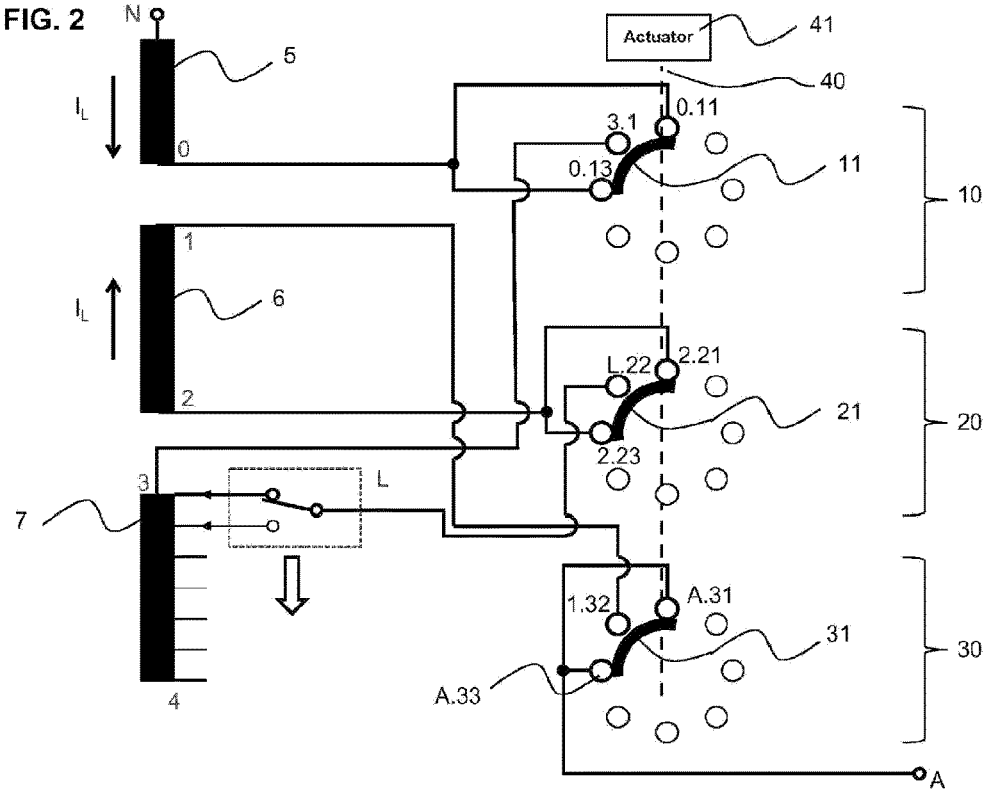
FIG. 2 shows a switching system according to the invention in a second stationary operating position.

Shown in FIG. 2 is the second stationary operating position of the switching system according to the invention. For this purpose, the first, second, and third bridge contacts 11, 21, and 31 were stepped counter-clockwise, in each case by two fixed contact positions in relation to FIG. 1, by the drive shaft 40. During the entire switch over process, which is not illustrated here, at least two fixed contacts of each switch subassembly 10, 20, and 30 were in this context constantly electrically connected by the correspondingly movable bridge contacts 11, 21, and 31, and thus each part of the main winding 5, of the coarse winding 6, and of the control winding 7 were galvanically linked. Illustrated exemplarily by the first switch subassembly 10, this means that the first bridge contact 11 moved toward the first control fixed contact 3.1 adjacent to the first main fixed contact 0.11, where only the first main fixed contact 0.11 and the first switch fixed contact L.1 were temporarily switched electrically bridging by the first bridge contact 11, before the first bridge contact 11 then moved onto the first control fixed contact 3.1 and brushed over it during the further switch over process such that the first control fixed contact 3.1, the first main fixed contact 0.11, and the first switch fixed contact L.1 were electrically bridged at this point of time in the switch over, before the movable first bridge contact 11 took up its next stationary operating position of FIG. 2, in which the first main fixed contact 0.11, the first control fixed contact 3.1, and the third main fixed contact 0.13 are eventually electrically bridged. The above-described also applies functionally analogously to the switch over process of the switch subassemblies 20 and 30.

In the second stationary operating position, the selector arms 9.1 and 9.2 or, as the case may be, the on-load tap changer 8, can also run through the entire control range of the control winding 7 in both directions such that the entire control winding 7, or also only parts of the control winding 7, can be connected or disconnected, as the case may be. In this stationary operating position, the load current IL takes the path from the second main terminal N through the main winding 5, up to the first main terminal 0, to the first main fixed contact 0.11 and to the third main fixed contact 0.13 of the first switch subassembly 10, from there via the movable first bridge contact 11 up to the first control fixed contact 3.1, from there to the first control terminal 3 via the selector 9 and via the on-load tap changer 8 to the switch terminal L. From there, the load current IL flows on to the fourth switch fixed contact L.22 of the second switch subassembly 20, then via the second bridge contact 21 to the second coarse fixed contact 2.21 and to the sixth coarse fixed contact 2.23, from there to the second coarse terminal 2, through the entire coarse winding 6 toward the first coarse terminal 1, and finally from there, via the seventh coarse fixed contact 1.32 of the third switch subassembly 30 and via the movable third bridge contact 31 to the first lead fixed contact A.31 and to the third lead fixed contact A.33, to the lead A.

For this purpose, the first main terminal 0 is electrically connected to the first main fixed contact 0.11 and to the third main fixed contact 0.13 in the second stationary operating position; the first bridge contact 11 electrically bridges the first main fixed contact 0.11, the third main fixed contact 0.13 and the first control fixed contact 3.1; and the first control fixed contact 3.1 is electrically connected to the first control terminal 3. Furthermore, the second coarse fixed contact 2.21 and the sixth coarse fixed contact 2.23 are electrically connected to the second coarse terminal 2; the second bridge contact 21 electrically bridges the second coarse fixed contact 2.21, the sixth coarse fixed contact 2.23, and the fourth switch fixed contact L.22; and the fourth switch fixed contact L.22 is electrically connected to the switch terminal L. Finally, the first lead fixed contact A.31 and the third lead fixed contact A.33 are connected to the lead A; the third bridge contact 31 electrically bridges the first lead fixed contact A.31, the third lead fixed contact A.33 and the seventh coarse fixed contact 1.32; and the seventh coarse fixed contact 1.32 is electrically connected to the first coarse terminal 1.

Figure 3:
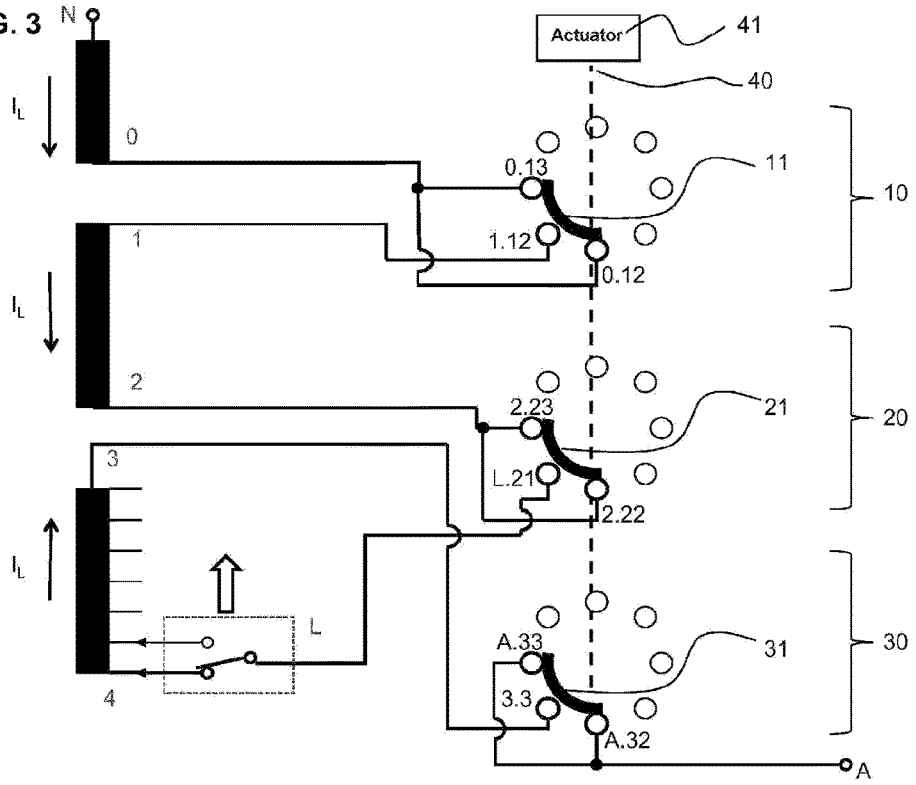
FIG. 3 shows a switching system according to the invention in a third stationary operating position.

Shown in FIG. 3 is the third stationary operating position of the switching system according to the invention. For this purpose, the first, second, and third bridge contacts 11, 21, and 31 were stepped counter-clockwise, in each case by two fixed contact positions in relation to FIG. 2, by means of the drive shaft 40. During the entire switch over process, which is not illustrated here, again at least two fixed contacts of each switch subassembly 10, 20, and 30 were in this context constantly electrically connected by the corresponding bridge contacts 11, 21, and 31, and thus each part of the main winding 5, of the coarse winding 6, and of the control winding 7 were galvanically linked.

In the third stationary operating position, the selector arms 9.1 and 9.2 or, as the case may be, the on-load tap changer 8, can also run through the entire control range of the control winding 7 in both directions such that the entire control winding 7, or also only parts of the control winding 7, can be connected or disconnected, as the case may be. In this stationary operating position, the load current IL takes the path from the second main terminal N through the main winding 5, up to the first main terminal 0, to the third main fixed contact 0.13 and to the third main fixed contact 0.12 of the first switch subassembly 10, from there via the movable first bridge contact 11 up to the fourth coarse fixed contact 1.12, from there to the first coarse terminal 1 through the entire coarse winding 6 toward the second coarse terminal 2. Subsequently, the load current IL flows on to the sixth coarse fixed contact 2.23 and to the fifth coarse fixed contact 2.22 of the second switch subassembly 20, continues via the bridging, movable second bridge contact 21 to the second switch fixed contact L.21, from there to the switch terminal L via the load diverter switch 8 and via the selector 9 to the second control terminal 4. From here, the load current IL finally flows on, through the control winding 7, up to the first control terminal 3 to the third control fixed contact 3.3 of the third switch subassembly 30 and to the movable third bridge contact 31 to the second and third lead fixed contact A.32 and A.33, to the lead A.

For this purpose, the first main terminal 0 is electrically connected to the third main fixed contact 0.13 and to the second main fixed contact 0.12 in the third stationary operating position; the first bridge contact 11 electrically bridges the third main fixed contact 0.13, the second main fixed contact 0.12, and the fourth coarse fixed contact 1.12; and the fourth coarse fixed contact 1.12 is electrically connected to the first coarse terminal 1. Furthermore, the fifth coarse fixed contact 2.22 and the sixth coarse fixed contact 2.23 are electrically connected to the second coarse terminal 2; the second bridge contact 21 electrically bridges the fifth coarse fixed contact 2.22, the sixth coarse fixed contact 2.23, and the second switch fixed contact L.21; and the second switch fixed contact L.21 is electrically connected to the switch terminal L. Finally, the second lead fixed contact A.32 and the third lead fixed contact A.33 are electrically connected to the lead A; the third bridge contact 31 electrically bridges the second lead fixed contact A.32, the third lead fixed contact A.33 and the third control fixed contact 3.3; and the third control fixed contact 3.3 is electrically connected to the first control terminal 3.

Figure 4:
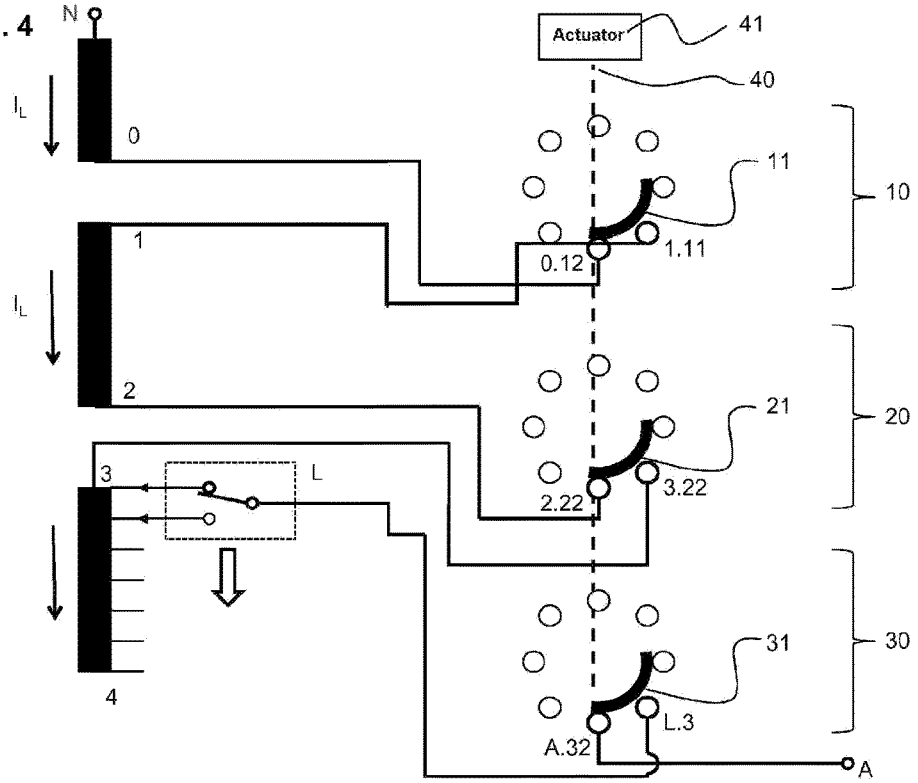
FIG. 4 shows a switching system according to the invention in a fourth stationary operating position.

Shown in FIG. 4 is the fourth stationary operating position of the switching system according to the invention. For this purpose, the first, second, and third bridge contacts 11, 21, and 31 were stepped counter-clockwise, in each case by two fixed contact positions in relation to FIG. 3, by the drive shaft 40. During the entire switch over process, which is not illustrated here, again at least two fixed contacts of each switch subassembly 10, 20, and 30 were in this context constantly electrically connected by the correspondingly movable bridge contacts 11, 21, and 31, and thus each part of the main winding 5, of the coarse winding 6, and of the control winding 7 were galvanically linked.

In the fourth stationary operating position, the selector arms 9.1 and 9.2 or, as the case may be, the on-load tap changer 8, can also run through the entire control range of the control winding 7 in both directions such that the entire control winding 7, or also only parts of the control winding 7, can be connected or disconnected, as the case may be. In this stationary operating position, the load current IL takes the path from the second main terminal N through the main winding 5, up to the first main terminal 0, to the second main fixed contact 0.12 of the first switch subassembly 10, from there via the movable first bridge contact 11 up to the first coarse fixed contact 1.11, from there to the first coarse terminal 1 through the coarse winding 6 toward the second coarse terminal 2. From there, the load current IL flows on to the fifth coarse fixed contact 2.22 of the second switch subassembly 20, then via the second bridge contact 21 to the fourth control fixed contact 3.22, and from there to the first control terminal 3 into the control winding 7. The load current IL subsequently takes the path via the selector 9 and via the load diverter switch 8.1 up to the switch terminal L, and finally from there, via the third switch fixed contact L.3 of the third switch subassembly 30 and via the third bridge contact 31 to the second lead fixed contact A.32, to the lead A.

For this purpose, the first main terminal 0 is electrically connected to the second main fixed contact 0.12 in the fourth stationary operating position; the first bridge contact 11 electrically bridges the second main fixed contact 0.12 and the first coarse fixed contact 1.11; and the first coarse fixed contact 1.11 is electrically connected to the first coarse terminal 1. Furthermore, the fifth coarse fixed contact 2.22 is electrically connected to the second coarse terminal 2; the second bridge contact 21 electrically bridges the fifth coarse fixed contact 2.22 and the fourth control fixed contact 3.22; and the fourth control fixed contact 3.22 is electrically connected to the first control terminal 3. Finally, the third switch fixed contact L.3 is electrically connected to the switch terminal L; the third bridge contact 31 electrically bridges the third switch fixed contact L.3 and the second lead fixed contact A.32; and the second lead fixed contact A.32 is electrically connected to the lead A. In this fourth stationary operating position, a mechanical switch can moreover be provided between the first switch fixed contact L.1 of the first switching system 10 and the third switch fixed contact L.3 of the third switching system 30, as well as between the first coarse terminal 1 and the third and seventh coarse fixed contact 1.31 and 1.32 of the third switching system 30, which mechanical switch can be open in this stationary operating position.

REFERENCE CHARACTERS

| | |
|---|---|
| 0 | First main terminal |
| 0.11 . . . 0.13 | Main fixed contacts |
| 1 | First coarse terminal |
| 1.11, 1.12 | Coarse fixed contacts |
| 1.31, 1.32 | Coarse fixed contacts |
| 2 | Second coarse terminal |
| 2.21 . . . 2.23 | Coarse fixed contacts |
| 3 | First control terminal |
| 3.1 | Control fixed contact |
| 3.21 . . . 3.22 | Control fixed contacts |
| 3.3 | Control fixed contact |
| 4 | Second control terminal |
| 5 | Main winding |
| 6 | Coarse winding |
| 7 | Control winding |
| 7.1 . . . 7.7 | Winding taps |
| 8 | On-load tap changer |
| 8.1 | Load diverter switch |
| 9 | Selector |
| 9.1 . . . 9.2 | Selector arms |
| 10 | First switch subassembly |
| 11 | First bridge contact |
| 12 | Vacant contact |
| 20 | Second switch subassembly |
| 21 | Second bridge contact |
| 22 | Vacant contact |
| 30 | Third switch subassembly |
| 31 | Third bridge contact |

-continued

| | |
|---|---|
| 32 | Vacant contact |
| 40 | Drive shaft |
| 41 | Actuator |
| N | Second main terminal |
| L | Switch terminal |
| L.1 | Switch fixed contact |
| L.21 . . . L.22 | Switch fixed contacts |
| L.3 | Switch fixed contact |
| A | Lead |
| A.31 . . . A.33 | Lead fixed contacts |
| IL | Load current |

The invention claimed is:

1. A switching system for a tapped transformer comprising a main winding with a first main terminal;

a coarse winding with a first coarse terminal and with a second coarse terminal;

a control winding with a first control terminal; and an on-load tap changer that has a switch terminal and that interacts with the control winding;

the switching system comprising a lead;

a first switch subassembly comprising a first main fixed contact that can be connected to the first main terminal;

a first coarse fixed contact that can be connected to the first coarse terminal;

a first control fixed contact that can be connected to the first control terminal;

a first switch fixed contact that can be connected to the first switch terminal; and a first movable bridge contact that is formed such that it electrically bridges at least two fixed contacts of its switch subassembly in each stationary operating position of the switching system and/or during each switch over process of the switching system;

a second switch subassembly comprising a second coarse fixed contact that can be connected to the second coarse terminal;

a second control fixed contact that can be connected to the first control terminal and/or that is connected to the first control fixed contact;

a second switch fixed contact that can be connected to the switch terminal and/or that is connected to the first switch fixed contact; and a second movable bridge contact that is formed such that it electrically bridges at least two fixed contacts of its switch subassembly in each stationary operating position of the switching system and/or during each switch over process of the switching assembly; and a third switch subassembly comprising a first lead fixed contact that is connected to the lead;

a third coarse fixed contact that can be connected to the first coarse terminal and/or that is connected to the first coarse fixed contact;

a third control fixed contact that can be connected to the first control terminal and/or that is connected to the first control fixed contact;

a third switch fixed contact that can be connected to the switch terminal and/or that is connected to the first switch fixed contact; and a third movable bridge contact that is formed such that it electrically bridges at least two fixed contacts of its switch subassembly in each stationary operating position of the switching assembly and/or during each switch over process of the switching system.

2. The switching system according to claim 1, further comprising a drive shaft, at which the bridge contacts are nonrotatably arranged.

3. The switching system according to claim 2, wherein the drive shaft is coupled to an actuator.

4. The switching system according to claim 3 wherein the actuator comprises a motor drive and/or a direct drive and/or a manual drive and/or a spring energy storage device.

5. The switching system according to claim 1, wherein the first switch subassembly comprises a second and a third main fixed contact that can each be connected to the first main terminal and/or that are connected to the first main fixed contact; and a fourth coarse fixed contact that can be connected to the first coarse terminal and/or that is connected to the first coarse fixed contact the first main fixed contact is arranged between the first switch fixed contact and the first control fixed contact;

the third main fixed contact is arranged between the first control fixed contact and the fourth coarse fixed contact; and the second main fixed contact is arranged between the fourth coarse fixed contact and the first coarse fixed contact.

6. The switching system according to claim 1, wherein the second switch subassembly comprises a fifth and a sixth coarse fixed contact that can each be connected to the second coarse terminal and/or that are connected to the second coarse fixed contact;

a fourth control fixed contact that can be connected to the first control terminal and/or that is connected to the first control fixed contact; and a fourth switch fixed contact that can be connected to the switch terminal and/or that is connected to the first switch fixed contact;

the second coarse fixed contact is arranged between the second control fixed contact and the fourth switch fixed contact;

the sixth coarse fixed contact is arranged between the fourth switch fixed contact and the second switch fixed contact; and the fifth coarse fixed contact is arranged between the second switch fixed contact and the fourth control fixed contact.

7. The switching system according to claim 1, wherein the third switch subassembly comprises a second and a third lead fixed contact that are each connected to the lead and/or to the first lead fixed contact; and a seventh coarse fixed contact that can be connected to the first coarse terminal and/or that is connected to the first coarse fixed contact;

the first lead fixed contact is arranged between the third coarse fixed contact and the seventh coarse fixed contact;

the third lead fixed contact is arranged between the seventh coarse fixed contact and the third control fixed contact; and the second lead fixed contact is arranged between the third control fixed contact and the third switch fixed contact.

8. The switching system according to claim 1, wherein the fixed contacts in each switch subassembly are arranged rotationally symmetrically and/or on a circular orbit around the drive shaft.

9. The switching system according to claim 1, wherein the individual switch subassemblies are electrically insulated from each other.

10. The switching system according to claim 1, wherein the switch subassemblies are arranged in different horizontal planes.

11. A switching system for a tapped transformer comprising a main winding with a first main terminal;

a coarse winding with a first coarse terminal and with a second coarse terminal;

a control winding with a first control terminal;

and an on-load tap changer that has a switch terminal and that interacts with the control winding;

the switching system comprising a lead, wherein the switching system that is in particular designed according to claim 1, is designed such that it can assume a first stationary operating position, in which it switches the coarse winding antiserially and the control winding antiserially to the main winding;

it can assume a second stationary operating position, in which it switches the coarse winding antiserially and the control winding serially to the main winding;

it can assume a third stationary operating position, in which it switches the coarse winding serially and the control winding antiserially to the main winding; and that it can assume a fourth stationary operating position, in which it switches the coarse winding serially and the control winding serially to the main winding.

12. The switching system according to claim 1, comprising several fixed contacts, at least one of which can in each case be connected to the first main terminal, the first coarse terminal, the first control terminal, the switch terminal, the second coarse terminal, the first control terminal, and the switch terminal and at least one other one of which is connected to the lead; and three movable bridge contacts that each electrically bridge at least two fixed contacts.

13. The switching system according to claim 1, which switching assembly is designed such that it can switch over from the first operating position to the second operating position, from the second operating position to the first and the third operating position, from the third operating position to the second and the fourth operating position, and from the fourth operating position to the third operating position; and/or that it cannot switch over from the first operating position to the fourth operating position, nor from the fourth operating position to the first operating position.

14. The switching system according to claim 1 that is designed such that it switches a current path through the control winding; and/or that it switches the first control terminal and the switch terminal or the control winding to the main terminal and the lead or to the main winding and/or the coarse winding in each operating position and/or during each switch over process.

15. The switching system according to claim 1, wherein the main winding, the coarse winding, and the control winding are galvanically separated from one another.

16. A tapped transformer, comprising a main winding with a first main terminal;

a coarse winding with a first coarse terminal and with a second coarse terminal;

a control winding with a first control terminal and an on-load tap changer that has a switch terminal and that interacts with the control winding; and a switching system according to claim 1.

17. The tapped transformer according to claim 16, wherein the first main fixed contact is connected to the first main terminal;

the first coarse fixed contact is connected to the first coarse terminal;

the first control fixed contact is connected to the first control terminal;

the first switch fixed contact is connected to the first switch terminal t;

the second coarse fixed contact is connected to the second coarse terminal;

the second control fixed contact is connected to the first control terminal and/or to the first control fixed contact;

the second switch fixed contact is connected to the switch terminal and/or to the first switch fixed contact;

the first lead fixed contact is connected to the lead;

the third coarse fixed contact is connected to the first coarse terminal and/or to the first coarse fixed contact;

the third control fixed contact is connected to the first control terminal and/or to the first control fixed contact; and the third switch fixed contact is connected to the switch terminal and/or to the first switch fixed contact.

18. The tapped transformer according to claim 1, wherein the main winding, the coarse winding, and the control winding are galvanically separated from one another.

19. A method of operating a switching system that is in particular designed according to claim 1, wherein the switching system is operated in four stationary operating positions such that the coarse winding and/or the control winding of the main winding is additively and/or subtractively connected, as the case may be, in dependence on the corresponding operating position.

20. A method of operating an electrical system comprising a main winding with a first main terminal;

a coarse winding with a first coarse terminal and with a second coarse terminal;

a control winding;

an on-load tap changer that has a switch terminal and that interacts with the control winding;

a lead; and, a switching system according to claim 1;

wherein the method according to the previous claim 18;

the coarse winding is switched antiserially and the control winding is switched antiserially to the main winding in a first stationary operating position;

the coarse winding is switched antiserially and the control winding is switched serially to the main winding in a second stationary operating position;

the coarse winding is switched serially and the control winding is switched antiserially to the main winding in a third stationary operating position; and the coarse winding is switched serially and the control winding is switched serially to the main winding in a fourth stationary operating position.

21. The method according to claim 20, wherein, in the first stationary operating position, the first main terminal is electrically connected to the first main fixed contact; the first bridge contact electrically bridges the first main fixed contact and the first switch fixed contact; and the first switch fixed contact is electrically connected to the switch terminal;

the second coarse fixed contact is electrically connected to the second coarse terminal; the second bridge contact electrically bridges the second coarse fixed contact and the second control fixed contact; and the second control fixed contact is electrically connected to the first control terminal; and the third coarse fixed contact is electrically connected to the first coarse terminal; the third bridge contact electrically bridges the first lead fixed contact and the third coarse fixed contact; and the first lead fixed contact is electrically connected to the lead.

22. The method according to claim 20, wherein, in the second stationary operating position, the first main terminal is electrically connected to the first main fixed contact and to the third main fixed contact; the first bridge contact electrically bridges the first main fixed contact, the third main fixed contact, and the first control fixed contact; and the first control fixed contact is electrically connected to the first control terminal;

the second coarse fixed contact and the sixth coarse fixed contact are electrically connected to the second coarse terminal; the second bridge contact electrically bridges the second coarse fixed contact, the sixth coarse fixed contact, and the fourth switch fixed contact; and the fourth switch fixed contact is electrically connected to the switch terminal; and the first lead fixed contact and the third lead fixed contact are connected to the lead; the third bridge contact electrically bridges the first lead fixed contact, the third lead fixed contact and the seventh coarse fixed contact; and the seventh coarse fixed contact is electrically connected to the first coarse terminal.

23. The method according to claim 20, wherein, in the third stationary operating position, the first main terminal is electrically connected to the third main fixed contact and to the second main fixed contact; the first bridge contact electrically bridges the third main fixed contact, the second main fixed contact, and the fourth coarse fixed contact; and the fourth coarse fixed contact is electrically connected to the first coarse terminal;

the fifth coarse fixed contact and the sixth coarse fixed contact are electrically connected to the second coarse terminal; the second bridge contact electrically bridges the fifth coarse fixed contact, the sixth coarse fixed contact, and the second switch fixed contact; and the second switch fixed contact is electrically connected to the switch terminal; and the second lead fixed contact and the third lead fixed contact is connected to the lead; the third bridge contact electrically bridges the second lead fixed contact, the third lead fixed contact, and the third control fixed contact; and the third control fixed contact is electrically connected to the first control terminal.

24. The method of operating a switching system according to claim 20, wherein, in the fourth stationary operating position, the first main terminal is electrically connected to the second main fixed contact; the first bridge contact electrically bridges the second main fixed contact and the first coarse fixed contact; and the first coarse fixed contact is electrically connected to the first coarse terminal;

the fifth coarse fixed contact is electrically connected to the second coarse terminal; the second bridge contact electrically bridges the fifth coarse fixed contact and the fourth control fixed contact; and the fourth control fixed contact is electrically connected to the first control terminal; and the third switch fixed contact is electrically connected to the switch terminal; the third bridge contact electrically bridges the third switch fixed contact and the second lead fixed contact; and the second lead fixed contact is electrically connected to the lead.

* * * * *